US008690701B2

(12) United States Patent
Okesaku

(10) Patent No.: US 8,690,701 B2
(45) Date of Patent: Apr. 8, 2014

(54) GOLF SWING TRAINING APPARATUS

(75) Inventor: Masahiro Okesaku, Ishikawa (JP)

(73) Assignee: G-Active Co., Ltd., Ishikawa (JP)

( * ) Notice: Subject to any disclaimer, the term of this patent is extended or adjusted under 35 U.S.C. 154(b) by 287 days.

(21) Appl. No.: 13/147,512

(22) PCT Filed: Feb. 1, 2010

(86) PCT No.: PCT/JP2010/051360
§ 371 (c)(1),
(2), (4) Date: Aug. 2, 2011

(87) PCT Pub. No.: WO2010/090157
PCT Pub. Date: Aug. 12, 2010

(65) Prior Publication Data

US 2011/0287851 A1 Nov. 24, 2011

(30) Foreign Application Priority Data

Feb. 4, 2009 (JP) ..... 2009-023997
Apr. 2, 2009 (JP) ..... 2009-090263

(51) Int. Cl.
*A63B 69/36* (2006.01)

(52) U.S. Cl.
USPC ..... 473/229; 473/257

(58) Field of Classification Search
USPC ..... 473/219, 226, 229, 257, 266; 482/93, 482/100, 111, 112, 113, 118
See application file for complete search history.

(56) References Cited

U.S. PATENT DOCUMENTS 5,039,091 A * 8/1991 Johnson ..... 482/64
5,284,464 A 2/1994 Lee, III et al.
5,301,948 A * 4/1994 Hundley ..... 473/229
7,585,228 B2 * 9/2009 McFarlin et al. ..... 473/258
2004/0152534 A1 * 8/2004 Chapman et al. ..... 473/257

FOREIGN PATENT DOCUMENTS

JP 06-121858 5/1994
JP 7016320 A 1/1995
JP 7255873 A 10/1995
JP 09-192282 7/1997

(Continued)

OTHER PUBLICATIONS

International Search Report mailed May 11, 2010 for PCT/JP2010-051360 filed Feb. 1, 2010.

(Continued)

*Primary Examiner* — Nini Legesse
(74) *Attorney, Agent, or Firm* — Fleit Gibbons Gutman Bongini & Bianco PL; Marty Fleit; Paul D. Bianco

(57) ABSTRACT

Provided is a golf swing training apparatus suited to strengthen target muscles in various body regions necessary for golf swings, and train a proper swing form. The apparatus is designed to, when a user performs a golf swing motion while grasping a grip of a golf swing mechanism whose height position is adjustable depending on a body height of a user, allow the grip to be moved along an arc, and transmit the arc movement of the grip from a swing-arm holder to a weight-arm holder to which a weight arm is fixed, through a swing-power transmission shaft, so as to swingingly move the weight arm about an axis of the weight-arm holder to allow a weight member on the weight arm to act as a load countering golf swing power. The apparatus has a mechanism capable of allowing the load based on the weight member fastened to the weight arm to be arbitrarily adjusted depending on individual differences in muscle strength.

8 Claims, 6 Drawing Sheets

(56) References Cited

FOREIGN PATENT DOCUMENTS

| | | | |
|---|---|---|---|
| JP | 2000202062 | A | 7/2000 |
| JP | 2000288117 | A | 10/2000 |
| JP | 2002346016 | A | 12/2002 |
| JP | 2005143529 | A | 6/2005 |
| JP | 2006122074 | A | 5/2006 |
| JP | 2006289022 | A | 10/2006 |

OTHER PUBLICATIONS

Written Opinion of the International Searching Authority mailed May 11, 2010 for PCT/JP2010-051360 filed Feb. 1, 2010.

* cited by examiner

GOLF SWING TRAINING APPARATUS

TECHNICAL FIELD

The present invention relates to a golf swing training apparatus for, during golf practice, training a proper swing form while effectively strengthening muscles necessary for golf swings.

BACKGROUND ART

Generally, an amateur golfer makes efforts for improving his/her golf score as much as possible, for example, by trying to increase the number of rounds in golf courses as well as the number of practice golf swings and the number of golf balls to be hit at a driving range, so as to develop his/her skill, and purchasing an expensive golf club so as to increase a carry distance of a hit golf ball. However, as for the carry distance, it is difficult to have a desired effect, in many cases.

In the above situations, there has recently been a golf swing simulation apparatus (see, for example, the following Patent Document 1). There has also been a golf swing practicing apparatus for learning an ideal posture between a setup position before a swing and a finish position after the swing (see, for example, the following Patent Document 2).

Further, as a training apparatus for actively strengthening muscles necessary during a golf swing (golf swing muscles), there has been a muscle-strengthening training apparatus which comprises: a rotational-load applying device; and a handle including a spirally-twisted stainless-steel rod member fixed to the rotational-load applying device and a grip pivotally attached to a bendable distal end of the rod member, wherein the rotational-load applying device is adapted to apply a rotational load when a user moves the grip of the handle from a backswing position to an impact position for hitting a golf ball (see, for example, the following Patent Document 3).

Furthermore, there has been a golf swing practicing apparatus comprising a swinging-movement control device connected to a grip through a swing arm and an intermediate arm, wherein a resistance or load based on an operating oil within the swinging-movement control device is increased in a course of a swinging movement of the swing arm along with a downswing where a user moves the grip from a backswing position to a lowermost position as a golf-ball hitting position (see, for example, the following Patent Document 4).

The above golf swing practicing apparatuses intended to strengthen the golf swing muscles include various types having a compact structure and a large-scale or complicated structure. However, in all of the apparatuses, the load for strengthening the muscles is constant, and it is impossible to adjust the load depending on individual differences in physical strength.

PRIOR ART DOCUMENTS

[Patent Documents]
[Patent Document 1] JP 2002-346016A
[Patent Document 2] JP 2005-143529A
[Patent Document 3] JP 09-192282A
[Patent Document 4] JP 06-121858A

SUMMARY OF THE INVENTION

Problem to be Solved by the Invention

In golf-related fields, a golf swing simulation apparatus, a golf swing practicing apparatus or a golf swing muscles training apparatus has been presented. Among them, some apparatuses are intended to actively strengthen the golf swing muscles. However, in all of such apparatuses, a countering force (opposing force) against golf swing power is constant, and it is impossible to adjust the countering force depending on individual differences in muscle strength, for example, to adjust a range of the countering force to be applied within a full trajectory of a golf swing, or a level of the countering force.

Moreover, as is obvious, even if it is tried to train the golf swing muscles to the next level as the muscles are strengthened, there is not any apparatuses suitable for achieving this purpose.

If it becomes possible to actively strengthen muscles physically necessary in various desired ranges within an arc trajectory of a grip of a golf club during a period after a player grasps the grip to start a backswing through until the club reaches a finish position of a follow-through swing through an impact position of a downswing starting from a top position of the backswing, a result more desirable for enhancing the golf swing power can be obtained.

Particularly, although a training to allow a head of a golf club to be maintained to stay on a proper swing plane during a golf swing largely contributes to an improvement in the carry distance, an apparatus meeting this need is hardly found out.

Meanwhile, if there is an apparatus additionally usable for training a swing motion with a specific trajectory corresponding to a bodily movement where a player accurately moves both arms in a small angular range in a pendulum manner, which is ideal for a short golf swing such as an approach shot essential for improving a golf score, such an apparatus is more advantageous.

Means for Solving the Problem

In order to solve the above problems, the present invention comprises the following mechanism.

In one aspect of the present invention, there is provided a golf swing training apparatus designed to, when a user performs a golf swing while grasping a grip of a golf swing mechanism, allow the grip to be moved along an arc, and transmit the arc movement of the grip through a swing-power transmission shaft to which a swing-arm holder is fastened, while converting it to a rotational movement causing a weight-arm holder to which a weight arm is fixed, to be rotated about an axis thereof so as to allow a weight member on the weight arm to act as a load effective in developing golf swing power.

Preferably, the golf swing training apparatus is designed to transmit the arc movement of the grip to a drive gear coaxially fixed to the swing-power transmission shaft and then to an interlocking gear disposed opposed to the drive gear and adapted to be rotated in a direction opposite to that of the drive gear, wherein the weight-arm holder is adapted to be rotated coaxially with the interlocking gear so as to allow the weight member on the weight arm fastened to the weight-arm holder to act as the load effective in developing the golf swing power.

Preferably, in the golf swing training apparatus, the golf swing mechanism comprises: a slide arm; a swing arm connected to an input end of the swing-power transmission shaft; and a sliding member, wherein the grip is connected to the slide arm, and the slide arm is adapted, in response to the arc movement of the grip grasped by the user between a setup position and a finish position after a golf swing, to be slidingly moved in a longitudinal direction of the swing arm through the sliding member, and wherein the golf swing mechanism includes a combination of a lock stopper for locking the slide arm and the swing arm together in a relatively non-slidable manner on an as-needed basis, and a variable stopper for allowing the slide arm and the swing arm to be relatively slidingly moved only in a predetermined range.

Preferably, in the golf swing training apparatus, the drive gear and the interlocking gear are selected from a plurality of pairs of gears prepared to have different gear ratios including a gear ratio of 1:1, so as to adjust an angular position of the arc movement of the grip to be permitted along with a golf swing motion, and a position where the weight member acts as the load.

Preferably, the golf swing training apparatus 4 is designed to, when a user performs a golf swing motion while grasping the grip of the golf swing mechanism, swingingly move the swing arm about an axis of the swing-arm holder, while swingingly moving the weight arm having the weight member set thereon, in a direction opposite to that of the swing arm, so as to establish an energy balance between action and counteraction of rotational forces.

Preferably, in the golf swing training apparatus, the weight member is adapted to be set at a desired longitudinal position of the weight arm, in such a manner that a positioning nut is screwed on an external thread portion of the weight arm at a desired position so as to allow the weight member to be clamped between the positioning nut and a pressure nut, whereby the load effective in developing the golf swing power can be adjusted while maintaining the weight member at a same weight.

Preferably, in the golf swing training apparatus, the weight-arm holder combined with the weight arm is adapted to be assembled to an interlocking shaft, while setting an assembling angle in any angular orientation within 360 degrees, so as to allow the weight member to act as the load effective in developing the golf swing power, in any range of the arc movement of the grip.

Effect of the Invention

The golf swing training apparatus according to the present invention has the following excellent effects.

1. Based on using the golf swing training apparatus of the present invention, it becomes possible to strengthen muscles in various regions necessary during a golf swing, such as abdominal muscle, back muscle, lateral muscle and arm muscle.

2. It becomes possible to repeatedly practice for performing a golf swing without uprising from a forward-inclined posture during the swing, while training muscles necessary for maintaining the forward-inclined posture, so as to allow a swing axis of a user to become stable.

3. A weight of the weight member and an attaching angle of the weight member can be freely selectively set in any range within the full trajectory of the arc movement of the grip, so that it becomes possible to strengthen muscles necessary for maintaining a stable swing axis to perform a swing on a swing plane defined by a series of movements between a setup position and a finish position, while keeping a proper posture. Thus, the swing axis conforms to an axis of the swing plane, and thereby a carry distance of a hit golf ball will be largely increased.

4. The load effective in developing the swing power can be increased only by changing a position of the weight member to be fastened to the weight arm, in a direction from a base end toward a distal end of the weight arm, and a level of the load at the same position can be freely changed by increasing or reducing the number of the weight member. Thus, the weight of the weight member can be arbitrarily selected, for example, depending on individual differences in user's muscle strength, or a target region of a user's body to be subjected to a muscle-strengthening training 5. A user can grasps the grip and set the grip at a desired position while increasing or reducing a distance between the grip and the swing-arm holder through the sliding member, so that it becomes possible to utilize a phenomenon that a countering force of the weight member is increased or reduced based on the principle of leverage even if the weight of the weight member on the weight arm is constant.

6. The assembling or attaching angle of the weight-arm holder can be freely set to any value within 360 degrees, so that it becomes possible to freely selectively apply the load of the weight member in any range within the full trajectory of the arc movement of the grip, depending on a purpose of the golf swing training.

7. Alternatively, the attaching angle of the weight-arm holder may be set to a fixed value. In this case, the swing-arm holder holding the golf swing mechanism may be designed to be freely attached at any angle within 360 degrees to obtain the same effect.

8. The golf swing training apparatus can cope with individual difference in body height and muscle strength, and can be used for both swings of right-handed and left-handed users, in the same manner.

9. The weight-arm holder may have an angular scale marked on an outer periphery thereof, and a pointer adapted to be stopped at a maximum rotation angle, or may be provided with an angle meter. In this case, a user can check that, along with strengthening in muscles, a rotation angle of the weight-arm holder is gradually increased, which serves as a source of encouragement to continue the training

BRIEF DESCRIPTION OF THE DRAWINGS

FIG. 7(*b*) is a vertical sectional view of the structure in FIG. 7(*a*).

DESCRIPTION OF EMBODIMENTS

Figure 1:
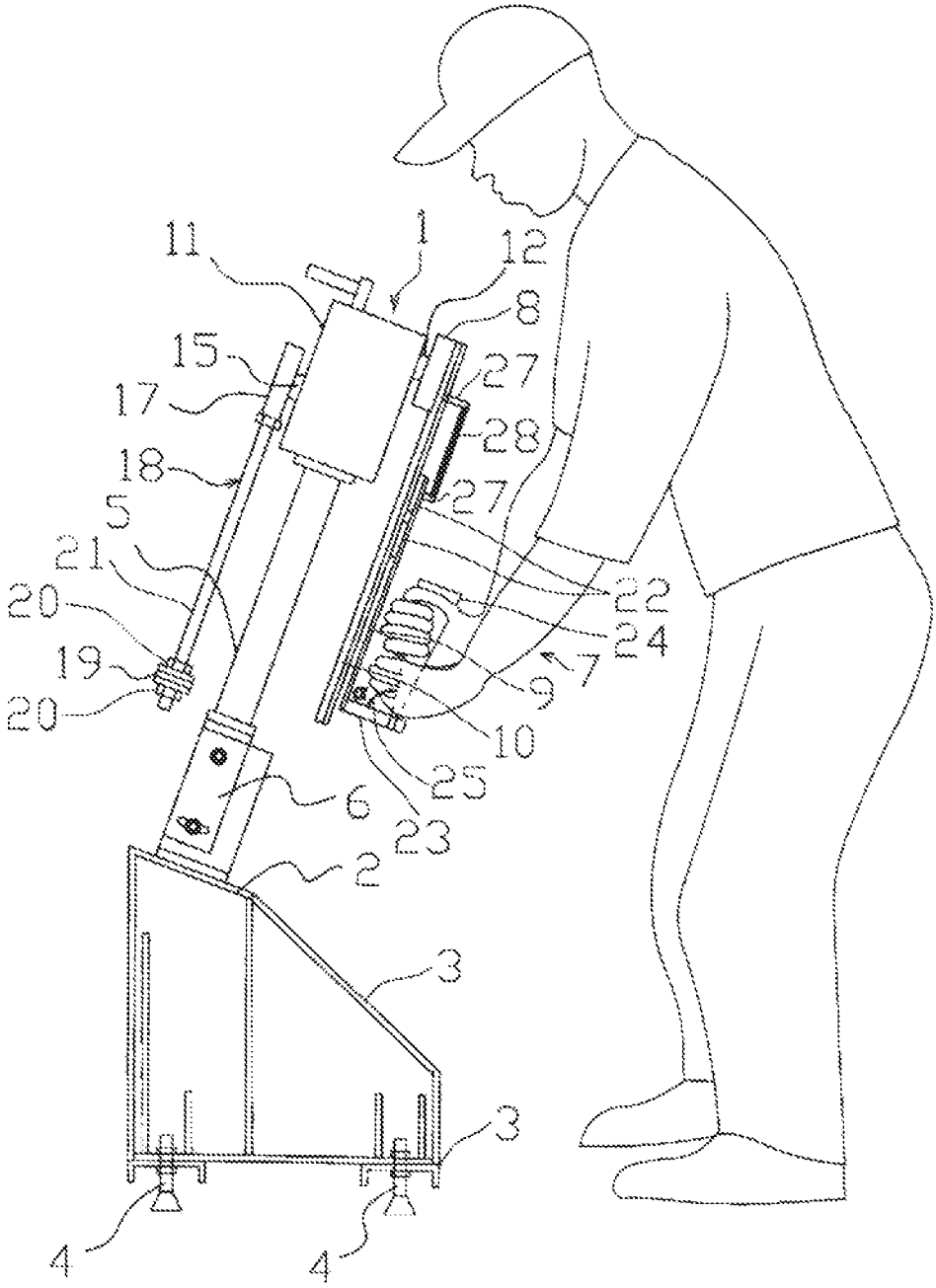
FIG. 1 is a side view illustrating a golf swing training apparatus of the present invention.

With reference to the drawings, the present invention will now be described based on an embodiment thereof.

In FIGS. 1 to 4, a golf swing training apparatus 1 according to one embodiment of the present invention has a base section comprising an inclined frame 2, a support frame 3 for stably supporting the inclined frame 2, and an up-down adjuster pad 4 for adjusting height positions of the inclined frame 2 and the support frame 3 depending on individual differences in user's body height.

The inclined frame 2 is assembled with a stand 5 through an angle adjusting arm 6 adapted to freely change a forward inclination angle of the stand 5, and the stand 5 has a distal end on which a shaft box 11 is mounted. The shaft box 11 houses a drive gear 13 assembled to an output end of a swing-power transmission shaft 12. The swing-power transmission shaft 12 has an input end disposed outside the shaft box 11 and connected with a golf swing mechanism 7 including an aftermentioned swing arm 10, through a swing-arm holder 8. A rotational force of the drive gear 13 is transmitted to an interlocking gear 14 assembled to an interlocking shaft 15. The interlocking shaft 15 has an output end disposed outside an openable/closable cover 16 of the shaft box 11 and assembled with a weight arm 18 through a weight-arm holder 17. The weight arm 18 has a distal end formed with an external thread 21 in a wide region enough to allow a weight member 19 illustrated in FIG. 6 to be slidingly moved to a desired position and fastened by upper and lower nuts 20.

Figure 4:
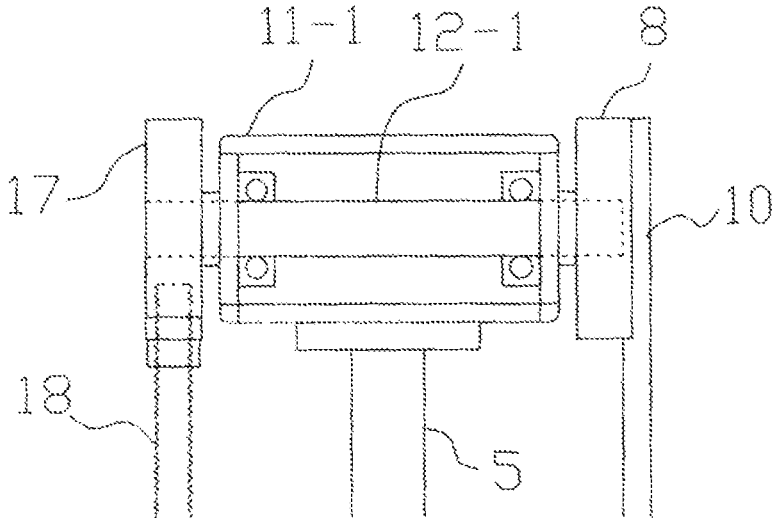
FIG. 4 is a vertical sectional view taken along a plane including an axis of a swing-arm holder, a swing-power transmission shaft and a weight-arm holder, which illustrates another example of the mechanism for transmitting the arc movement of the grip, while converting it to the rotational movement causing the weight-arm holder to be rotated about the axis thereof FIG. 5(*a*) is a schematic side view illustrating a mechanism for narrowing a slidable range of a slide arm and a swing arm.

In another example illustrated in FIG. 4, a shaft box 11-1 is mounted on the distal end of the stand 5, and a swing-power transmission shaft 12-1 has an input end disposed outside the shaft box 11-1 and connected with the golf swing mechanism 7 including the aftermentioned swing arm 10, through the swing-arm holder 8. The swing-power transmission shaft 12-1 has an output end disposed outside the shaft box 11-1 and assembled with the weight arm 18 through the weight-arm holder 17. The distal end of the weight arm 18 is formed with the external thread 21 in a wide region enough to allow the weight member 19 illustrated in FIG. 6 to be slidingly moved to a desired position and fastened by the upper and lower nuts 20.

The golf swing mechanism 7 fundamentally comprises a swing arm 10 fixed to the swing-arm holder 8, a slide arm 9 adapted to be slidingly moved through a sliding member 22, and a grip 24 immovably fixed to the slide arm 9 through a connection piece 23. In a special case, the golf swing mechanism 7 may be designed such that the grip 24 is rotatable about an axis thereof, and movable in a forward-backward direction by an appropriate amount to change an angle $\alpha$ between the connection piece 23 and the axis of the grip 24. In order to allow the grip 24 to be rotated about the axis thereof and moved by an appropriate amount to change the angle $\alpha$, a universal joint may be employed. The grip 24 may be attached to the connection piece 23 to extend downwardly from the connection piece 23, instead of being attached to extend upwardly from the connection piece 23.

The sliding member 22 is typically comprised of a so-called linear motion system designed such that a block is slidingly moved in a longitudinal direction of a rail having a rectangular shape in cross-section, through a ball bearing or a roller bearing. Alternatively, it may be any other suitable types, such as a type in which an outer cylinder in a double cylinder structure is slidingly moved in a longitudinal direction thereof, or a type in which a block is slidingly moved in a longitudinal direction of the swing arm 10 through a wheel-like roller instead of a bearing mechanism. In essence, it may be any type having a mechanism capable of allowing a distance between the grip 24 and the swing-arm holder 8 to smoothly follow a trajectory of an arc movement of the grip 24.

Alternatively, a required length of the slide arm 9 fastened to the block of the sliding member (linear motion system) 22 may be fixed to a portion of the swing arm 10 fixed to the swing-arm holder 8, and the grip 24 may be connected to the swing arm 10 corresponding to the rail of the linear motion system, through the connection piece 23. In this case, a component having the rail of the sliding member (linear motion system) 22, and a component having the block fixedly mounting the slide arm 9 thereon, are used under a condition that respective attaching positions of the two components are simply interchanged therebetween, so that the golf swing mechanism 7 brings out exactly the same functionality.

Figure 2:
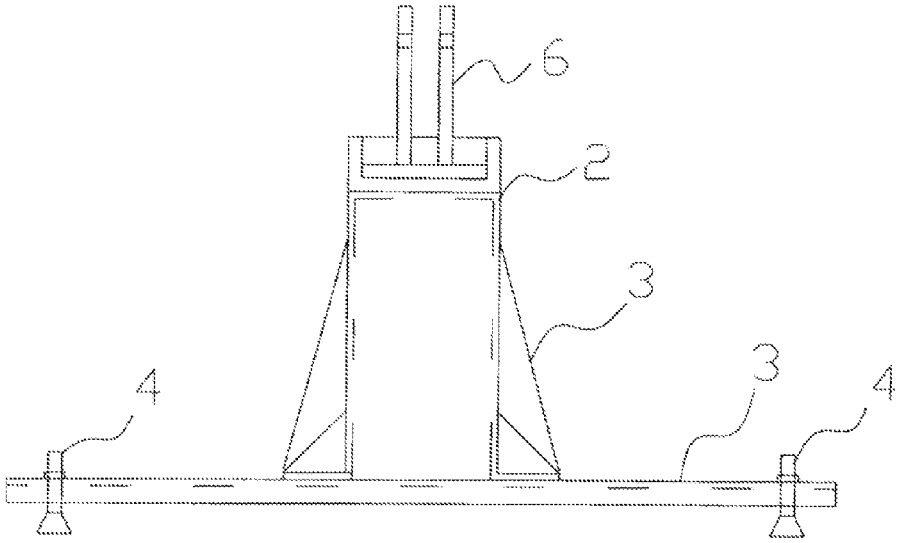
FIG. 2 is a front view illustrating an inclined frame and a support frame.

FIG. 2 is a front view illustrating the base portion of the golf swing training apparatus (FIG. 1), when viewed in a forward direction of a user.

Figure 3:
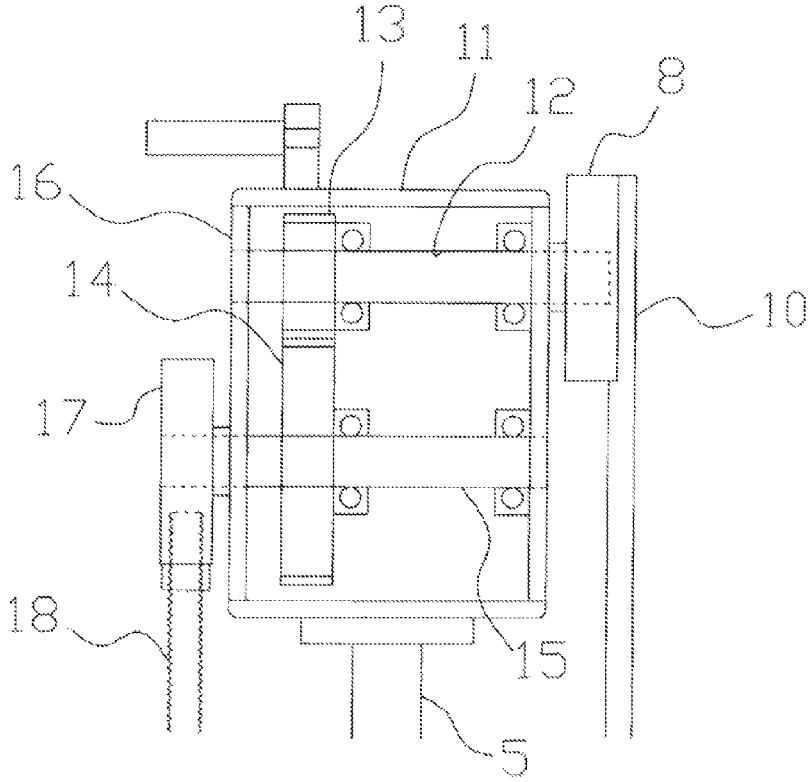
FIG. 3 a vertical sectional view taken along a plane including an axis of a swing-power transmission shaft and a drive gear and an axis of an interlocking gear and an interlocking shaft, which illustrates one example of a mechanism for transmitting an arc movement of a grip, while converting it to a rotational movement causing a weight-arm holder to be rotated about an axis thereof.

In the example illustrated in FIG. 3, a swinging movement of the swing arm 10 fixed to the swing-arm holder 8 is transmitted through the swing-power transmission shaft 12 while being converted to a rotational force (torque) causing the drive gear 13 assembled to the output end of the swing-power transmission shaft 12 to be rotated about an axis of the swing-power transmission shaft 12. Then, the rotation of the drive gear 13 is transmitted while being converted to a rotational force causing the interlocking gear 14 assembled to the interlocking shaft 15 to be rotated in a direction opposite to that of the drive gear 13, and further transmitted to cause a swing movement of the weight arm 18 assembled to the weight-arm holder 17 fixed to the interlocking shaft 15 at a position outside the shaft box 11.

In the example illustrated in FIG. 4, the swing arm 10 and the weight arm 18 are fixed to the input end and the output end of the swing-power transmission shaft 12-1 disposed outside the shaft box 11-1, through the swing-arm holder 8 and the weight-arm holder 17, respectively, so that a swing movement of the swing arm 10 swingably moved about an axis of the swing-arm holder 8 is directly transmitted to the weight-arm holder 17 to cause the weight arm 18 to be swingably moved.

Figure 5:
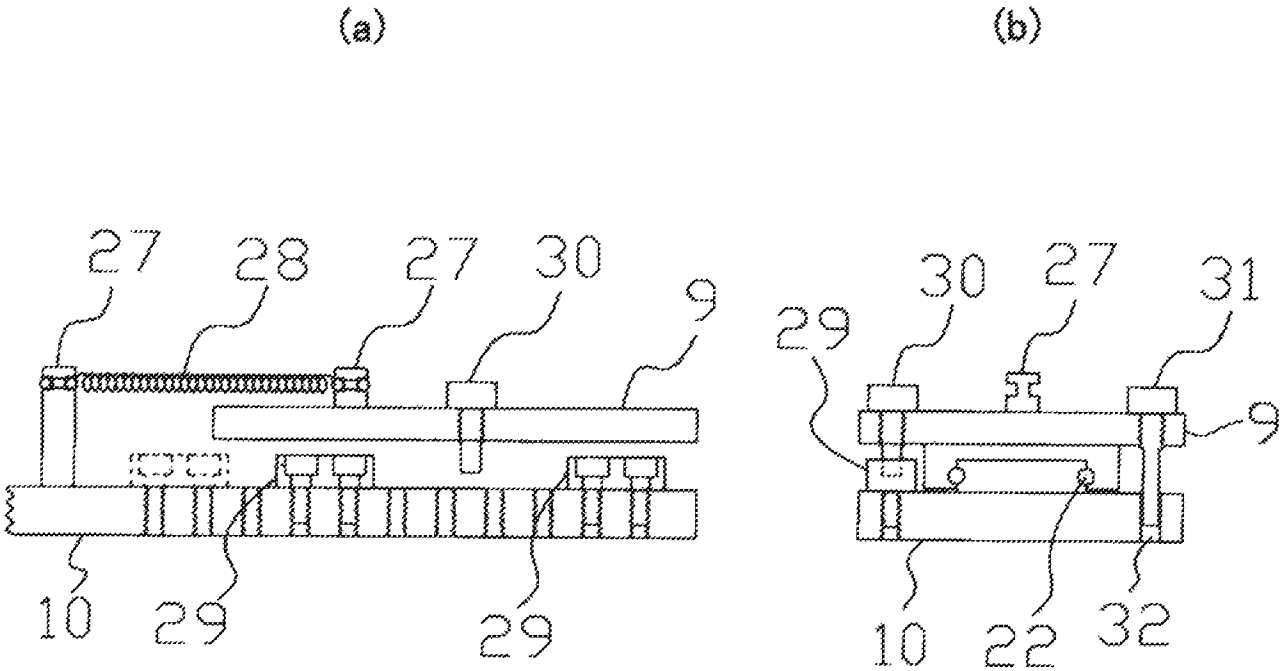
FIG. 5(*b*) is a front view of the mechanism in FIG. 5(*a*), wherein a sliding member (linear motion system) is additionally illustrated.

Although the sliding member 22 is not illustrated in FIG. 5(*a*) to avoid complexity of illustration, a spring 28 having a spring force equal to a weight of the slide arm 9 is disposed between a spring pin 27 fixed to the swing arm 10 and a spring pin 27 fixed to the slide arm 9, so as to allow the slide arm 9 to be smoothly moved through the sliding member 22. Based on reducing a weight of the slide arm 9, the spring pins 27 and the spring 28 may be omitted.

FIG. 5(*a*) also illustrates a structure designed to allow the slide arm 9 integrated with a variable stopper 30 to be moved only in a range between respective set positions of two slidable-range setting blocks 29 to narrow or slightly widen a stroke range of the grip 24 in a manner suited to perform a repetitive practice. For example, one of the slidable-range setting blocks 29 may be shifted to a position indicated by the dotted line to widen the slidable range, or may be narrowed in a reverse manner.

As above, based on setting the slidable-range setting blocks 29 and the variable stopper 30, it becomes possible to repeatedly learn a pendulum-like movement of a golf club in practice of approach shots, or the like. However, the slidable-range setting blocks 29 and the variable stopper 30 are not essential components, but may be eliminated to simplify the golf swing mechanism.

The slide arm 9 is adapted to be slidingly moved with respect to the swing arm 10 through the sliding member such as the linear motion system 22, as described above. In this case, as illustrated in FIG. 5(*b*), a lock stopper 31 can be inserted into and fixed to a stopper hole 32 according to need, to completely prevent the slide arm 9 from being slidingly moved.

Figure 6:
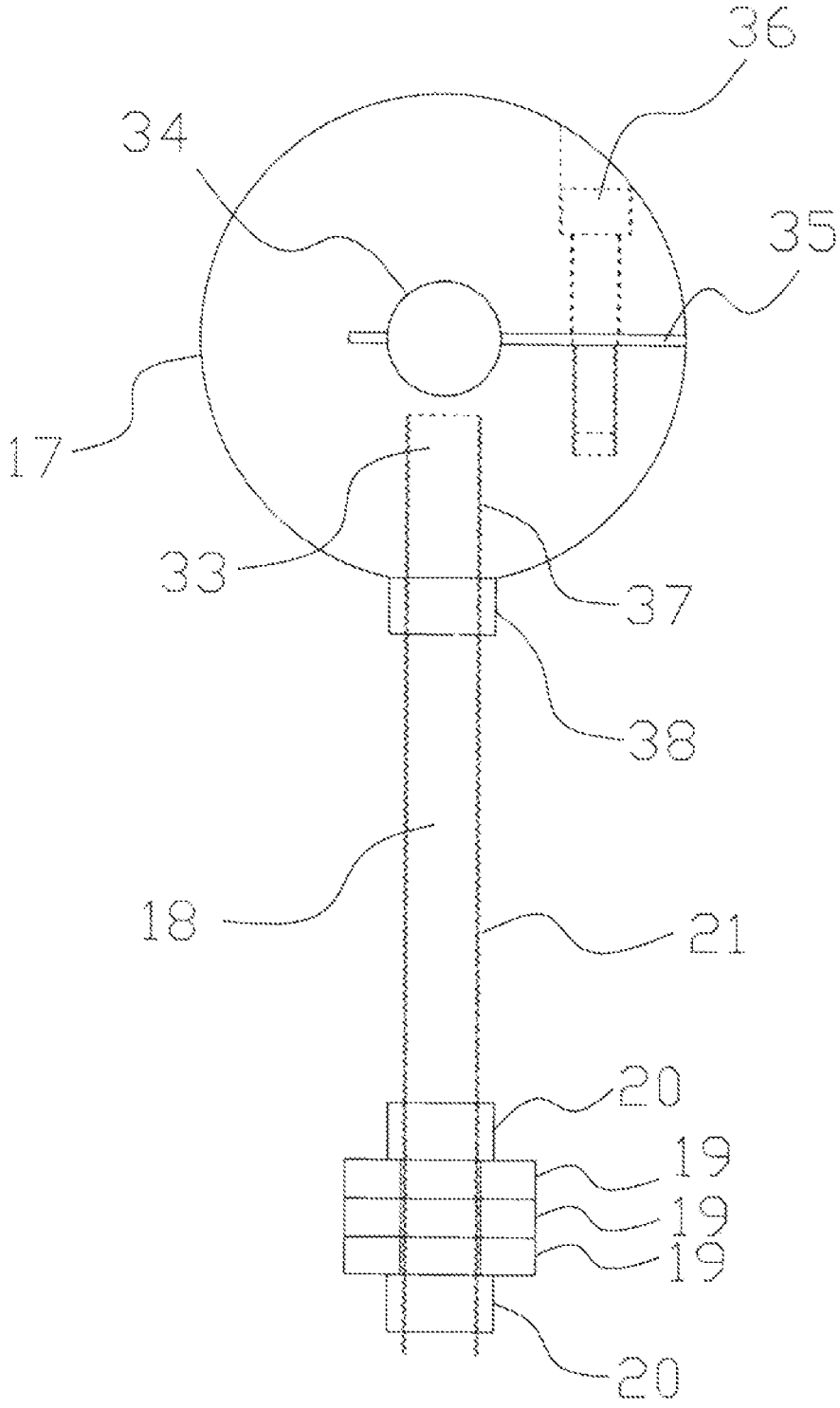
FIG. 6 is a schematic front view illustrating the weight-arm holder, a weight arm and a weight member, wherein the weight arm and the weight member are illustrated in section.

FIG. 6 is a front view of the weight-arm holder 17 to which a base end 33 of the weight arm is assembled. As illustrated in FIG. 6, the interlocking shaft 15 (see FIG. 1) is inserted into an interlocking-shaft fixing hole 34 and fixed by tightly closing a clamping slit 35 using an embedded hexagon socket head bolt 36. Further, the base end 33 of the weight arm 18 is screwed in a weight-arm screw hole 37 formed to extend from an outer periphery toward an axis of the weight-arm holder 17, and fixed by a nut 38. The number of the weight members 19 is set to three, wherein the three weight members 19 are fastened to a portion having the external thread 21 formed over the entire length of the weight arm 18 or on the distal end of the weight arm 18, using the upper and lower nuts 20.

In cases where the structure comprising the swing-power transmission shaft 12-1 illustrated in FIG. 4 is employed, the weight-arm holder 17 is attached to the output end of the swing-power transmission shaft 12-1.

Figure 7:
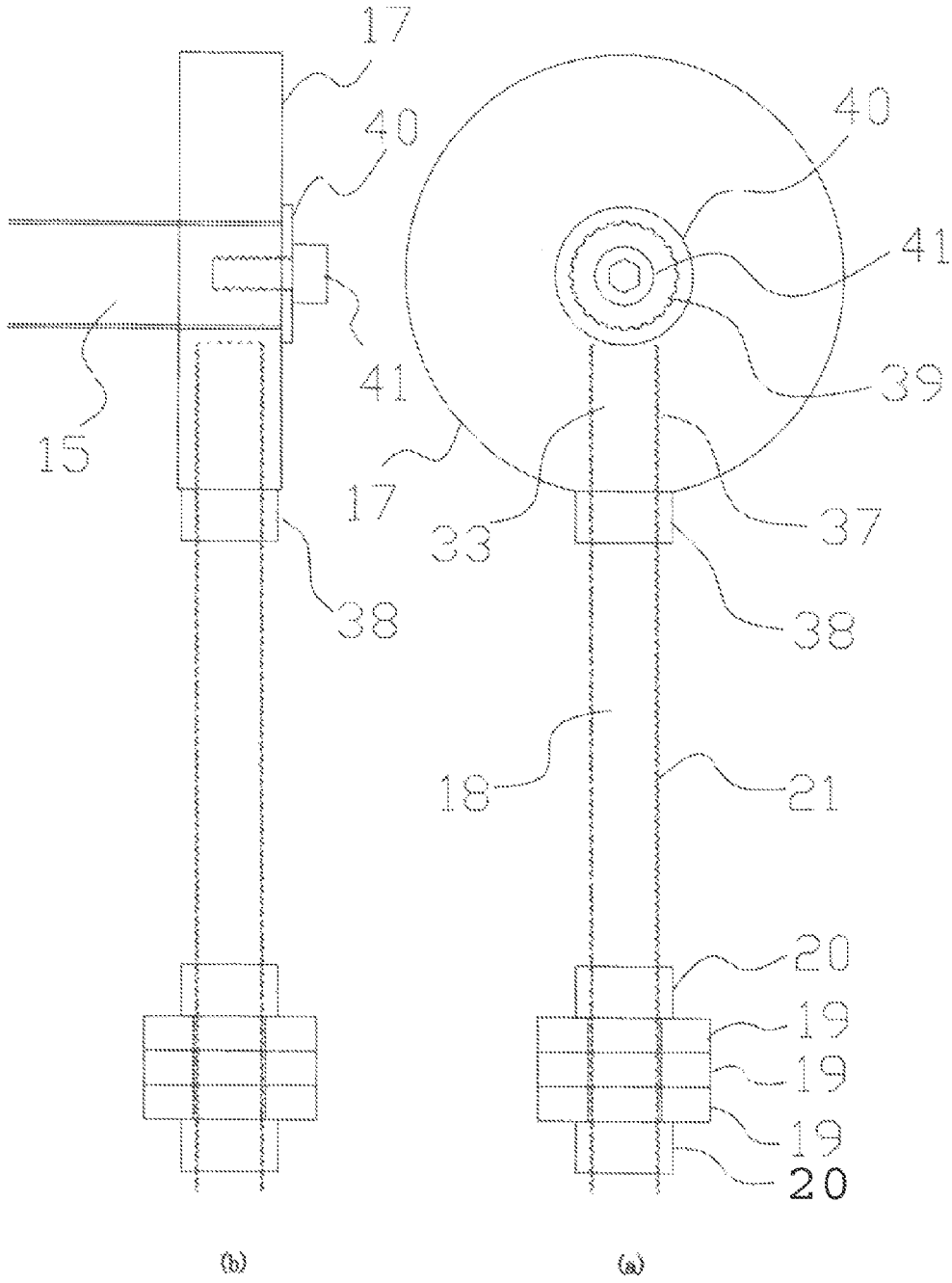
FIG. 7(*a*) is a schematic diagram illustrating a spline connection structure as one example of a structure for attaching a weight-arm holder.

FIG. 7(*a*) is a schematic diagram illustrating a structure in which the interlocking shaft 15 is inserted into the weight-arm holder 17 through a spline connection 39, and they are fastened together by a lock bolt 41 through a washer 40. FIG. 7(*b*) is a sectional side view of the structure in FIG. 7(*a*).

An operation of the golf swing training apparatus according to this embodiment will be more specifically described below.

Firstly, a user of the golf swing training apparatus adjusts the forward inclination angle of the stand using the angle adjusting arm 6, and adjusts the height position of the grip 24 using the up-down adjuster pad 4, in conformity of his/her physique. Then, the user grasps the grip 24 to perform a golf swing. Along with the golf swing, according to an arc movement of the grip 24 around the axis of the swing-arm holder 8, the slide arm 9 is smoothly moved in the longitudinal direction through the sliding member such as the linear motion system 22. In addition, the arc movement of the grip 24 is transmitted to the swing arm 10 through the sliding member 22, and further transmitted while being converted to a rotational movement about the swing-power transmission shaft 12, because the swing arm 10 is fixed to the swing-arm holder 8 attached to the input end of the swing-power transmission shaft 12.

In the embodiment illustrated in FIG. 3, the arc movement of the grip 24 is transmitted to cause the drive gear 13 assembled to the output end of the swing-power transmission shaft 12 to be rotated, and cause the interlock gear 14 meshed with the drive gear 13 at a given gear ratio to be rotated in a direction opposite to that of the drive gear 13. More specifically, for example, in cases where the gear ratio of the driven gear 13 to the interlocking gear 14 is 1:2, when the grip 24 is moved along an arc between a three-o'clock position and a nine-o'clock position on a clock face, i.e., moved along an arc by 180 degrees, the interlocking gear 14 is rotated by 90 degrees. Thus, a plurality of pairs of gears each having a different gear ratio may be prepared, and the drive gear 13 and the interlocking gear 14 may be selected therefrom so as to change a gear ratio therebetween, according to need. In this case, a rotational angle of the interlocking gear 14 can be variously changed with respect to the trajectory of the arc movement of the grip 24.

The rotation transmitted to the interlocking gear 14 is transmitted while being converted to a rotation causing the weight-arm holder 17 fixed to the interlocking shaft 15 at a position outside the shaft box 11 to be rotated about the axis of the interlocking shaft 15, and further converted to a force causing the weight member 19 in the vicinity of the distal end of the weight arm 18 assembled to the weight-arm holder 17 to be moved about the axis of the interlocking shaft 15.

In the example illustrated in FIG. 4, when a user performs a golf swing while grasping the grip 24 of the golf swing mechanism 7, the arc movement of the grip 24 is transmitted from the golf swing mechanism 7 to the swing-power transmission shaft 12-1 coaxially fastened to the swing-arm holder 8 to which the swing arm 10 is fixed, and converted to a force causing the weight arm 18 to be swingingly moved about the axis of the swing-power transmission shaft 12-1. Preferably, with respect to the swing-power transmission shaft 12-1, respective attaching angles of the swing arm 10 fixed to the swing-arm holder 8, and the weight arm 18 fixed to the weight-arm holder 17, are set to become slightly different from each other. Specifically, given that it is explained using a clock face, the attaching angles may be adjusted according to user's preference, for example, in such a manner that, when the grip 24 is oriented toward a three-o'clock position, the weight member 19 of the weight arm 18 is oriented toward a five-o'clock position.

When the weight member 19 of the weight arm 18 is fastened to the distal end of the weight arm 18, it acts as a maximum countering force, even if the number of the weight members 19 is, for example, one. The countering force based on the weight member 19 becomes smaller as the weight member 19 is fastened to a position closer to an intermediate region of the weight arm 18, i.e., a distance between the weight-arm holder 17 and the weight member 19 becomes shorter. It is understood that the countering force based on the weight member 19 can be increased by gradually increasing the number of the weight members 19 and shifting a fastening position of the weight member 19 toward the distal end of the weight arm 18.

A countering force based on the weight member 19 depending on the number and the fastening position of the weight members 19 to be fastened to the weight arm 18, i.e., a load against a golf swing, can be selected as a load corresponding to muscle strength of each user. In addition, the load can be increased as the muscle strength is improved. Further, the load can be selectively set depending on a target region of a user's body to be subjected to a muscle-strengthening training, for example, can be set to a value suitable for training of only a left hand as a leading hand, or a value suitable for training of only a right hand.

More specifically, in a golf swing of a right-handed user, when the user wants to eliminate a load countering swing power, in a certain range within a trajectory of an arc movement of the grip, the range can be set by assembling the weight arm 18 to the weight-arm holder 17 in such a manner as to allow the weight 19 of the weight arm 18 to be located at an angular position between a position beyond twelve o'clock and a six-o'clock position on a clock face.

Although the weight-arm holder 17 can be attached while setting the attaching angle thereof in any range within 360 degrees, the attaching angle of the weight-arm holder 17 may be set to a constant value. In this case, an effective range of the countering force based on the weight member 19 can also be set in a desired position by allowing the swing-arm holder 8 to be attached while freely setting the attaching angle thereof within 360 degrees.

If the distal end of the weight arm 18 in an extending direction thereof is moved beyond a twelve-o'clock position on a clock face, a problem is likely to occur due to gravitational acceleration of the falling weight member 19. Thus, it is preferable to provide a swing stopper (not illustrated) for the weight arm 18 so as to prevent the swinging movement beyond the twelve-o'clock position.

Industrial Applicability

The golf swing training apparatus according to the present invention is capable of allowing a user to practice golf swings conveniently at any time at home, and usable as a training apparatus for strengthening muscles in various body regions necessary during a golf swing or leaning a proper posture during a golf swing.

Explanation Of Codes

1: golf swing training apparatus
2: inclined frame
3: support frame
4: up-down adjuster pad
5: stand
6: angle adjusting arm
7: golf swing mechanism
8: swing-arm holder
9: slide arm
10: swing arm
11, 11-1: shaft box
12, 12-1: swing-power transmission shaft
13: drive gear
14: interlocking gear
15: interlocking shaft
16: openable/closable cover of shaft box
17: weight-arm holder
18: weight arm
19: weight member
20: upper or lower nut
21: external thread
22: sliding member (linear motion system)
23: connection piece
24: grip
25: angle $\alpha$
26: output end of swing-power transmission shaft
27: spring pin
28: spring
29: slidable-range setting block
30: variable stopper
31: lock stopper
32: stopper hole
33: base end of weight arm
34: interlocking-shaft fixing hole
35: clamping slit
36: embedded hexagon socket head bolt
37: weight-arm screw hole
38: nut
39: spline connection
40: washer
41: lock bolt

What is claimed is:

1. An apparatus for golf swing training, the apparatus comprising:

a swing-power transmission shaft fastened to a swing-arm holder;

a weight arm fastened to a weight-arm holder, the weight arm having a weight member; and a golf swing mechanism, the golf swing mechanism having:

a grip connected to a slide arm;

a swing arm connected to an input end of the swing-power transmission shaft; and a sliding member;

wherein when a user trains with the apparatus, the user grasps the grip of the golf swing mechanism and performs a golf swing motion allowing the grip to be moved along an arc between a setup position and a finish position after performing the golf swing, transmitting arc movement through the swing-power transmission shaft and converting the arc movement to a rotational movement, the rotational movement rotating the weight-arm holder about an axis thereof allowing the weight member to act as a load effective for developing golf swing power in the user; and wherein the slide arm is slidingly moveable in a longitudinal direction of the swing arm through the sliding member in response to the arc movement.

2. The apparatus for golf swing training according to claim 1, further comprising:

a drive gear coaxially fixed to the swing-power transmission shaft and an interlocking gear adapted to be rotated in a direction opposite a direction of the drive gear;

wherein the arc movement is transmitted to the drive gear and then to the interlocking gear; and wherein the weight-arm holder is rotated coaxially with the interlocking gear such that the weight member on the weight arm fastened to the weight-arm holder acts as the load effective in developing golf swing power in the user.

3. The apparatus for golf swing training according to claim 2, wherein the drive gear and the interlocking gear are selected from a plurality of pairs of gears having a gear ratio of 1:1 or having different gear ratios, thereby adjusting an angular position of the arc movement of the grip and a position where the weight member acts as the load.

4. The apparatus for golf swing training according to claim 1, wherein the apparatus is configured and arranged to swingingly move the swing arm about an axis of the swing-arm holder while swingingly moving the weight arm, having the weight member set thereon, in a direction opposite to direction of the swing arm, thereby establishing an energy balance between action and counteraction of rotational forces when a user grasps the grip of the golf swing mechanism and performs a golf swing.

5. The apparatus for golf swing training according to claim 1, wherein the weight-arm holder combined with the weight arm is configured to be assembled to an interlocking shaft, an assembly angle of the weight-arm holder with respect to the interlocking shaft and about an axis of the interlocking shaft is set in any angular orientation within 360 degrees, and the weight arm is fastened to the weight-arm holder such that a range of swing movement of the weight arm about an axis of the weight-arm holder is set in any angular orientation within 360 degrees, thereby allowing the weight member to act as the load effective in developing golf swing power, in any range of the arc movement of the grip.

6. The apparatus for golf swing training according to claim 1, wherein the golf swing mechanism further comprises:

a lock stopper; and a variable stopper;

wherein the lock stopper locks the slide arm and the swing arm in a relatively non-slidable position and the variable stopper allows the slide arm and swing arm to be relatively slidingly moveable in a predetermined range.

7. An apparatus for golf swing training, the apparatus comprising:

a swing-power transmission shaft fastened to a swing-arm holder;

a weight arm fastened to a weight-arm holder, the weight arm having a weight member; and a golf swing mechanism, the golf swing mechanism having:

a grip connected to a slide arm;

a swing arm connected to an input end of the swing-power transmission shaft;

a sliding member; and wherein when a user trains with the apparatus, the user grasps the grip of the golf swing mechanism and performs a golf swing motion allowing the grip to be moved along an arc between a setup position and a finish position after performing the golf swing, transmitting arc movement through the swing-power transmission shaft and converting the arc movement to a rotational movement, the rotational movement rotating the weight-arm holder about an axis thereof allowing the weight member to act as a load effective for developing golf swing power in the user;

wherein the weight member is configured to be set at a desired longitudinal position of the weight arm, such that a positioning nut is screwed on an external thread portion of the weight arm at a desired position allowing the weight member to be clamped between the positioning nut and a pressure nut, whereby the load effective in developing golf swing power can be adjusted while maintaining the weight member at a same weight;

wherein the slide arm is slidingly moveable in a longitudinal direction of the swing arm through the sliding member in response to the arc movement.

8. The apparatus for golf swing training according to claim 7, wherein the golf swing mechanism further comprises:

a lock stopper; and a variable stopper;

wherein the lock stopper locks the slide arm and the swing arm in a relatively non-slidable position and the variable stopper allows the slide arm and swing arm to be relatively slidingly moveable in a predetermined range.

* * * * *